United States Patent [19]

Von Schlemmer

[11] Patent Number: 4,827,384

[45] Date of Patent: May 2, 1989

[54] POCKETED HEADWEAR

[76] Inventor: Hans Von Schlemmer, P.O. Box 10148, Daytona Beach, Fla. 32020, now by change of name from Laszlo Szirtes

[21] Appl. No.: 182,890

[22] Filed: Apr. 18, 1988

[51] Int. Cl.[4] ..... F21L 7/00

[52] U.S. Cl. ..... 362/106; 2/199

[58] Field of Search ..... 362/106, 105; 2/171.4, 2/195, 199, 209.2

[56] References Cited

U.S. PATENT DOCUMENTS

| | | | |
|---|---|---|---|
| 1,146,979 | 7/1915 | Walters et al. | 362/106 |
| 1,572,210 | 2/1926 | Kolibas | 362/106 |
| 1,744,777 | 1/1930 | Lundgren | 362/106 |
| 2,640,992 | 6/1953 | Hassler | 2/199 |
| 2,744,256 | 5/1956 | Slotkin et al. | 2/195 |
| 4,406,040 | 9/1983 | Cannone | 24/3 J |
| 4,667,274 | 5/1987 | Daniel | 362/105 |

FOREIGN PATENT DOCUMENTS

| | | | |
|---|---|---|---|
| 1221782 | 1/1960 | France | 62/106 |
| 657200 | 8/1986 | Switzerland | 362/106 |

*Primary Examiner*—Ira S. Lazarus
*Assistant Examiner*—David G. Messer
*Attorney, Agent, or Firm*—Warren L. Franz

[57] ABSTRACT

Headwear in the form of a cap has a hemispherical crown, a crescent-shaped visor and a shield connecting the outer surface of the crown to the upper surface of the visor to form a pocket which opens onto the underside of the visor. The shield has an upper edge extending along a semi-circular section of the crown, a lower edge extending in elliptical fashion between the forward and rearward edges of the visor, and side edges extending along lines between the visor corners and the peak of the cap. In one embodiment, especially suited for night fishing, the visor has an upwardly crested central portion, and snap means is provided to removably hold a flashlight in the pocket so that the light beam is directed downwardly ahead of the user, but lateral light scattering is obstructed. In another embodiment, the pocket has a snap closure for use in retaining articles, such as a fishing license, therein.

20 Claims, 1 Drawing Sheet

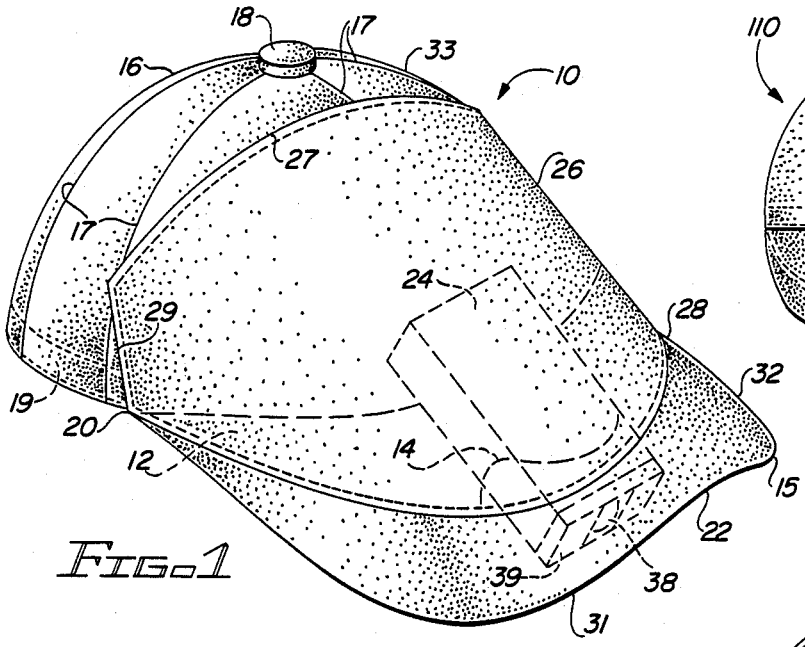
FIG. 1
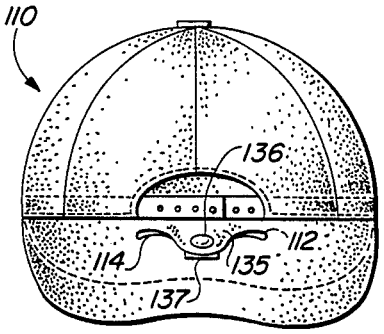
FIG. 6
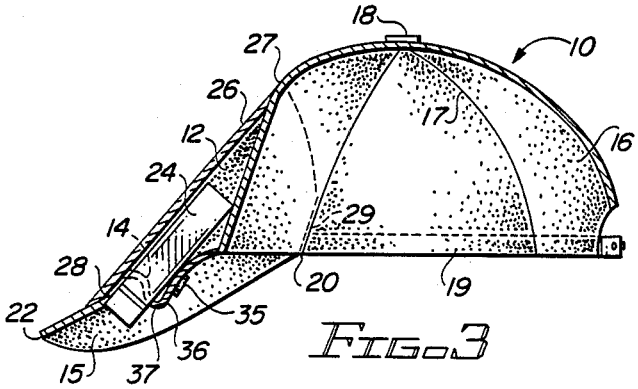
FIG. 3
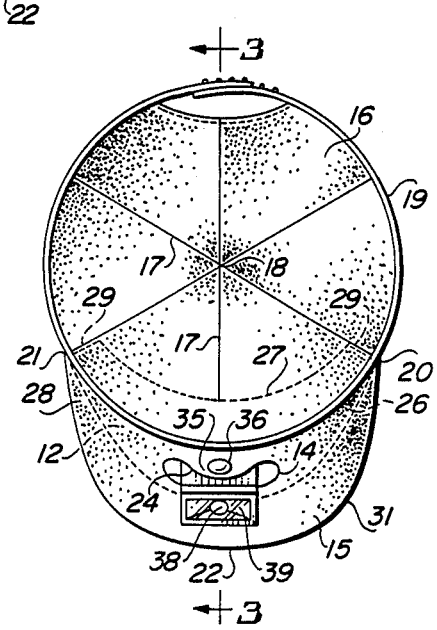
FIG. 2
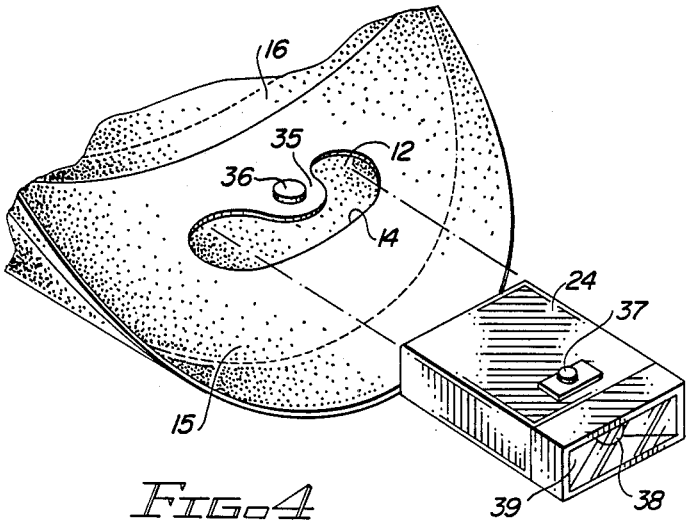
FIG. 4
FIG. 5
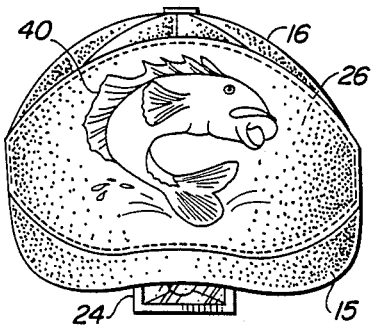

POCKETED HEADWEAR

This invention relates to headwear having a visor pocket therein; especially headwear having a visor pocket adapted to removably receive a battery-operated directional flashlight in shielded position therein.

BACKGROUND OF THE INVENTION

Examples of conventional headwear of the type to which the present invention relates are shown in U.S. Pat. Nos. 1,146,979; 1,572,210; 1,744,777; and French Pat. No. 1,221,782. Such patents illustrate enclosures for the storage of batteries and the like, and show arrangements for the inclusion on the headwear of a source of illumination for various purposes. These are relatively complex setups, involving the awkward and cumbersome placement of components, and the enclosures are specifically configured confinements dedicated to particular applications. No provision is made for removal of the light source for use apart from the headwear. Furthermore, the produced light pattern is inconvenient for applications such as night fishing where it is desired to direct a narrow beam of light, with little lateral projection, to a work area directly ahead and just above the waist of the wearer.

U.S. Pat. No. 4,406,040 illustrates a mechanism for attaching a conventional flashlight illumination device to the brim of a hat. While this overcomes the lack of usability elsewhere of the lamp of the foregoing devices, the light is beamed down ahead of the user from above the visor, and no shielding is provided against lateral scattering.

SUMMARY OF THE INVENTION

The present invention provides headwear having a crown, a visor projecting forwardly peripherally at the front of the base of the crown, a shield connecting a midsection of the crown with the upper surface of the visor, and a pocket formed between opposing portions of the crown, visor and shield which opens onto the underside of the visor at a point rearwardly of the visor forward edge.

In a preferred embodiment of the invention, described in greater detail below, pocketed headwear in accordance with the principles of the invention has an opening formed with means for removably receiving a battery-operated directional flashlight in shielded position therein, so that light from the flashlight is directed down in front of the user toward a working position of the user's hands, to provide headwear particularly adapted and suited for use in night fishing to bait hooks and remove the catch, without disturbing other fishermen and without frightening uncaught fish.

In another embodiment, the opening is formed with a releasable closure, to provide a concealed pocket for general purpose storage of items such as a fishing license, or the like.

BRIEF DESCRIPTION OF THE DRAWINGS

Embodiments of the invention have been chosen for purposes of illustration and description, and are shown in the accompanying drawings, wherein:

FIG. 1 is a perspective view of headwear in the form of a fishing cap embodying the principles of the invention;

FIG. 2 is a bottom plan view of the cap of FIG. 1;

FIG. 3 is a section view taken along the line 3—3 of FIG. 2.;

FIG. 4 is an exploded view showing the positioning of a flashlight within the pocket of the cap of FIG. 1;

FIG. 5 is a front elevation view showing an embellished embodiment of the cap of FIG. 1; and FIG. 6 is a rear elevation view showing an alternative embodiment of the invention.

Throughout the drawings, like elements are referred to by like numerals.

DESCRIPTION OF THE PREFERRED EMBODIMENT

Pocketed headwear in accordance with the invention is shown in FIGS. 1–3 in the form of a cap 10 having a concealed pocket 12 with an opening 14 onto the underside of a visor 15. The visor 15 is crescent-shaped and projects forwardly and downwardly peripherally at the front portion of the base of a generally hemispherical crown 16.

The crown 16 may be formed in conventional manner from flexible woven or other suitable headcovering material, such as by attaching arcuate spherical segments of the same together in a known way along seamlines 17 which meet at a central zenith or peak 18 of the cap 10 and depend outwardly and downwardly therefrom to join a thickened circular headband 19 at the bottom edges thereof. The peak 18 may be ornamentally provided with a material-covered button or other known ornamentation.

The visor 15 projects outwardly in a user-shading manner peripherally of the crown 16 at headband 19, from a first corner point 20 to a second corner point 21 along most of the front half thereof. The visor is stiffened in conventional manner to retain its projected form, and may be upwardly crested at its center 22 (see FIG. 1) to provide an aesthetically pleasing effect and to raise it up ahead of the opening 14 of the pocket 12 to laterally obstruct the light emanating from a flashlight 24 removably received, as further described below, within the pocket 12. Suitable visor construction may be effected by using a shaped stiffening member of cardboard, celluloid or other rigid or semi-rigid material and covering the same with the flexible material used in the construction of the crown 16. The inner edge of the visor 15 can be secured at the headband 19 to the crown 16 by sewing or other known means.

The cap 10 in accordance with the principles of the invention is also provided with a shield 26 constituting a second stiffened member connecting a midsection of the outer surface of the front half of the crown 16 with a midsection of the upper surface of the visor 15. A preferred configuration of shield 26 includes upper 27, lower 28, and opposite side 29 edges, as shown. The upper edge 27 is rounded and extends generally partially along a semi-circular path of a section of the hemispherical crown taken through the center of the base (viz. great circle section) at a forward angular displacement of approximately 30° from the peak 18 (the 0° mark) to the front of the headband 19 (the 180° mark). The lower edge 28 is also rounded and extends generally along an elliptical path between the corners 20, 21 at which the visor 15 joins the crown 16 and along a midsection of the upper surface of the visor 15. The elliptical curve of the lower edge 28 preferably lies between the forward edge 31 of the visor 15 and the headband 19 or rearward edge of the visor 15, and has a shorter major axis (transverse axis) than the elliptical path shaped by the visor forward edge 31. The side edges 29 extend generally along respective lines running from the visor corners 20, 21 to the peak 18 of the cap 10 (see FIG. 1). Such configuration of the shield 26 gives a stepped appearance to the outwardly visible front of the cap 10, the cap in front elevation having a centrally peaked upwardly-angled crescent-shaped visible outer visor section 32, followed by a more steeply upwardly-angled rearwardly and outwardly swept shield portion 26, followed by a less upwardly-angled visible front upper crown section 33 of more or less hemispherical shape.

The shield 26, like the visor 15, may be formed of a stiffening member of cardboard, celluloid or other rigid or semi-rigid material covered with woven material like that used for the crown 16. The edges 27, 28, 29 are joined along their entire lengths at seamlines to attach them to adjacent portions of the visor 15 and crown 16. In this manner, the pocket 12 assumes the configuration of the enclosure shown in the drawings, completely surrounded and concealed except at the opening 14. The opening 14 is centrally located on the underside of the visor 15 at a point rearwardly of the seamline of attachment of the lower edge 28 to the upper surface of the visor 15 and forward of the seamline of attachment of the underside of the visor 15 to the frontal portion of the crown 16 at headband 19. The confines of the pocket 12 are defined by the opposing surfaces of the outside of crown 16, the upper surface of visor 15, and the concealed undersurface of the shield 26.

The opening 14 is created by forming an elongated aperture centrally through visor 15 rearwardly of and in general alignment with the forward edge 31 of the visor 15. The aperture 14 may be buttonhole stitched to provide reinforcement to the sides of the opening and prevent unraveling of threads. The opening may further be provided with a pivotable flap 35 or similar extension attached to or formed integrally with the visor 15 and including a snap fastener 36 or similar device for matingly interengaging with a complementary snap fastener 37 attached to an outer surface of a flashlight 24, as shown in FIG. 4, rearwardly of the bulb 38 and lens 39 components thereof. The flashlight 24 may be of any of a number of commercially available self-contained units which can be inserted into the pocket 12 through the opening 14 and releasably secured therein by means of the fastener elements 36, 37, with the bulb 38 and lens 39 portions thereof protruding from the opening 14 and oriented at an angle which directs the light emitted therefrom downwardly and forwardly, along an axial line substantially parallel to the slope of the shield 26 forwardly from the cap peak 18, to shine out from the visor under the upwardly crested portion.

The side portions of the visor 15 rearwardly directed from the crested center portion 22 may be made to depend below the lens 39 location when the flashlight 24 is positioned as described within the pocket 12, so that the peripheral light emission from the bulb 38 is prevented from shining laterally of the cap. This is particularly advantageous where the pocketed cap 10 is used to hold a flashlight 24 for a hands-free source of illumination for a fisherman in the baiting of hooks and removal of the catch. The crested raised visor 15 acts to contain the illumination and direct it where it is needed, preventing its disturbing other fishermen or frightening other uncaught fish. The snap fastener arrangement 36, 37 permits the flashlight 24 to be readily removed from the pocket 12 for use in an ordinary handheld manner, if desired.

A suitable commercially available flashlight for use as flashlight 24 is a rectangular AA battery-operated compact flashlight such as is available from Eveready Battery Corporation, St. Louis, Missouri or from Duracell, Bethel, Connecticut. The Durabeam TM portable flashlight from Duracell, for example, has a length of 4" and a rectangular lens of 1"×2". The opening 14 for such a flashlight 24 is made a little wider laterally than the flashlight lens width, but approximately the same front-to-rear opening dimension as the height of the flashlight, i.e. the opening 14 has approximate dimensions of 3"×1" with the flap 35 folded away from the aperture. The flap 35 is preferably formed as part of the visor 15 itself, with the snap 36 running through the internal stiffener of the visor 15. With a celluloid plastic stiffener covered by cloth material, the extension 35 has a biasing effect which urges it toward a position covering the opening 14 and thus assists in retaining the flashlight in the pocket 12, the angling being ensured by dimensioning the cap so that the distal end of the diagonally opposite surface of the flashlight 24 is pressed against the undersurface of the stiffened shield 26.

FIG. 5 illustrates a front elevation view of the cap 10 with a suitable flashlight 24 installed in the pocket 12 thereof, so that the lens 39 and bulb 38 are outwardly and angularly directed therefrom. The outer surface of shield 26 presents a convenient surface for the affixing of indicia of choice 40, such as the fish portrait illustrated. A choice of transparent or translucent stiffener material for the visor 15 and shield 26 covered with a cloth or fabric material capable of some light transmission, permits the escaping light from the flashlight 24 to diffuse as an illuminated background to the indicia 40. A choice of other materials can be made to totally eliminate such a backlighting effect, if it is not desired.

The invention also makes possible the provision of a concealed pocket for articles other than a flashlight. FIG. 6 illustrates a similar pocket 112 of a cap 110 in which an opening 114 is releasably closed by means of a closure flap 135 having a snap 136 which mates with another snap 137 located on the opposite side of the opening 114 therefrom. It will be appreciated that zipper, synthetic materials which adhere when pressed together such as "VELCRO" or other closure means may take the place of the illustrated snap fastener elements 136, 137 and that the pocket 112 may serve as a convenient repository for holding a fishing or hunting license for outdoorsman use, or for other purposes.

It can, thus, be appreciated by consideration of the illustrative embodiments shown and described above that the invention provides pocketed headwear having a concealed pocket located between opposing portions of a crown, visor and shield which is accessible through an opening formed on the underside of the visor, and which in one form may be configured to contain a flashlight for directed, hands-free usage thereof.

It will also be appreciated that various substitutions and modifications may be made to the examples described above without departing from the spirit and scope of the present invention as defined by the claims appended hereto.

What is claimed is:

1. Headwear comprising:

a generally hemispherical crown;

a crescent-shaped visor projecting forwardly peripherally at the front of the base of said crown, said visor being formed with an aperture therethrough rearwardly of the forward edge thereof; and a shield connecting the outer surface of said crown with the upper surface of said visor to form a pocket between opposing portions of said crown, visor and shield which opens onto the underside of said visor through said aperture.

2. Headwear as in claim 1, wherein said shield connects a midsection between the peak and the base of the outer surface of said crown with a midsection between the forward and rearward edges of said upper surface of said visor.

3. Headwear as in claim 2, wherein said shield has a rounded upper and two straight side edges joined to said crown, and a rounded lower edge joined to said visor, with junctures between said lower edge and said side edges defining corners.

4. Headwear as in claim 3, wherein said upper edge extends generally along a semi-circular path of a section of said hemispherical crown taken through the center of said base.

5. Headwear as in claim 4, wherein said lower edge extends generally along an elliptical path between said forward and rearward edges of said visor from the corners at which said visor joins said crown.

6. Headwear as in claim 5, wherein said side edges respectively extend generally along lines from said corners to said peak.

7. Headwear as in claim 6, wherein said semicircular path along which said upper edge extends has a forward angular displacement from said peak of approximately 30 degrees.

8. Headwear as in claim 1, further comprising means for securing a flashlight within said pocket in an orientation that directs light emitted from the flashlight downwardly and forwardly out from below the visor.

9. Headwear as in claim 8, wherein said aperture is centrally located, wherein said visor has an upwardly crested central portion, and wherein said means for securing a flashlight within said pocket comprises means for orienting the flashlight so that lateral emission of light is obstructed by said upwardly crested portion.

10. Headwear as in claim 9, wherein said flashlight securing means comprises means for releasably securing the flashlight within said pocket.

11. Headwear as in claim 8, wherein said flashlight securing means comprises an extension of said visor at said aperture, and a fastener element of said extension for releasably interengaging with the flashlight at a point rearwardly of bulb and lens components thereof.

12. Headwear as in claim 1, further comprising means for releasably closing said aperture to prevent items stored in said pocket from falling out therefrom.

13. Headwear as in claim 12, wherein said releasable closure means comprises an extension of said visor at said aperture, a first fastener element on said extension, and a complementary second fastener element on said visor opposite said extension for matingly interengaging with said first fastener element.

14. Headwear as in claim 1, wherein said shield is made of light diffusing material; and wherein said headwear further comprises indicia located on the outer surface of said shield, and means for securing a flashlight within said pocket so that light emanating from said flashlight will provide a diffused background illumination for said indicia.

15. Headwear comprising:

a generally hemispherical crown having a peak, a base and a front;

a crescent-shaped visor projecting forwardly and downwardly peripherally of the base at the front of said crown, said visor being formed with an aperture therethrough rearwardly of a forward edge thereof;

a shield connecting a midsection between the peak and the base of the outer surface of said crown with a midsection between the forward and rearward edges of the upper surface of said visor to form a pocket between opposing portions of said crown, visor and shield which opens onto the underside of said visor through said aperture;

a flashlight; and means releasably securing said flashlight within said pocket in an orientation that directs light emitted form the flashlight downwardly and forwardly out from below said visor.

16. Headwear as in claim 15, wherein said aperture is centrally located, wherein said visor has an upwardly crested central portion, and wherein said means for releasably securing said flashlight within said pocket comprises means for orienting the flashlight so that lateral emission of light is obstructed by said upwardly crested portion.

17. Headwear as in claim 15, wherein said shield has a rounded upper and two straight side edges joined to said crown, and a rounded lower edge joined to said visor, with junctures between said lower edge and said side edges defining corners.

18. Headwear as in claim 17, wherein said upper edge extends generally along a semi-circular path of a section of said hemispherical crown taken through the center of said base; wherein said lower edge extends generally along an elliptical path between said forward and rearward edges of said visor from the corners at which said visor joins said crown; and wherein said side edges respectively extend generally along lines from said corners to said peak.

19. Headwear as in claim 18, wherein said semicircular path along which said upper edge extends has a forward angular displacement from said peak of approximately 30 degrees.

20. Headwear as in claim 19, wherein said flashlight is an elongated device having lens and bulb elements; wherein said visor and shield are made of stiffened materials; and wherein said means for releasably securing said flashlight comprises a flap on said visor extending into said aperture, a first fastener element located on said extension, and a complementary second fastener element located on said flashlight at a point rearwardly of bulb and lens components thereof in such a way as to align the flashlight axially with the slope of the shield.

* * * * *